US009121365B1

(12) United States Patent
Wagner

(10) Patent No.: US 9,121,365 B1
(45) Date of Patent: Sep. 1, 2015

(54) LINER COMPONENT FOR A CYLINDER OF AN OPPOSED-PISTON ENGINE

(71) Applicant: Achates Power, Inc., San Diego, CA (US)

(72) Inventor: Bryant A. Wagner, Santee, CA (US)

(73) Assignee: Achates Power, Inc., San Diego, CA (US)

( * ) Notice: Subject to any disclaimer, the term of this patent is extended or adjusted under 35 U.S.C. 154(b) by 35 days.

(21) Appl. No.: 14/255,756

(22) Filed: Apr. 17, 2014

(51) Int. Cl.

| | |
|---|---|
| ***F02B 25/08*** | (2006.01) |
| ***F02F 1/00*** | (2006.01) |
| ***F02B 75/28*** | (2006.01) |
| ***F02F 1/02*** | (2006.01) |

(52) U.S. Cl.
CPC ..... *F02F 1/004* (2013.01); *F02B 75/28* (2013.01); *F02F 1/02* (2013.01)

(58) Field of Classification Search
CPC ..... F02F 1/02; F02F 1/16; F02F 2001/008; F02B 75/28
USPC ..... 123/51 BD, 51 R, 193.2
See application file for complete search history.

(56) References Cited

U.S. PATENT DOCUMENTS

| | | | | |
|---|---|---|---|---|
| 1,231,903 | A * | 7/1917 | Junkers | 123/41.78 |
| 1,410,319 | A | 3/1922 | Junkers | |
| 1,818,558 | A | 11/1929 | Junkers | |
| 1,820,069 | A * | 8/1931 | Herr | 29/888.061 |
| 1,892,277 | A | 12/1932 | Junkers | |
| 1,996,837 | A * | 4/1935 | Shoemaker | 123/41.74 |
| 3,620,137 | A * | 11/1971 | Prasse | 92/159 |
| 4,237,831 | A * | 12/1980 | Noguchi et al. | 123/51 BA |
| 6,648,597 | B1 | 11/2003 | Widrig et al. | 415/200 |
| 8,485,147 | B2 | 7/2013 | Liu et al. | 123/51 B |
| 2015/0159582 | A1 * | 6/2015 | Williams et al. | 123/193.2 |

FOREIGN PATENT DOCUMENTS

| | | |
|---|---|---|
| DE | 674781 C | 4/1939 |
| DE | 301521 C | 3/2013 |
| FR | 1226003 A | 7/1960 |

OTHER PUBLICATIONS

International Search Report and Written Opinion for PCT application PCT/US2015/026128, mailed Jun. 25, 2015.

* cited by examiner

*Primary Examiner* — Marguerite McMahon
(74) *Attorney, Agent, or Firm* — Terrance A. Meador

(57) ABSTRACT

The structure of a cylinder with longitudinally-separated exhaust and intake ports includes a powdered metal (PM) ring sintered over grooves and/or slots in the exhaust port bridges and/or the top center (TC) portion of a cylinder liner.

20 Claims, 4 Drawing Sheets

LINER COMPONENT FOR A CYLINDER OF AN OPPOSED-PISTON ENGINE

RELATED APPLICATIONS

This application contains subject matter related to the subject matter of U.S. patent application Ser. No. 13/942,515, published as US 2013/0298853 A1, which is a divisional of U.S. patent application Ser. No. 13/136,402, now U.S. Pat. No. 8,485,147.

BACKGROUND

The field covers the structure of a ported cylinder of an opposed-piston engine. More specifically the field is directed to a liner component with cooling passageways and stiffening members defined by a ring of powdered material encircling the liner.

With reference to FIG. 1, an opposed-piston engine includes at least one cylinder in which pistons 20, 22 move in opposition. As taught in related U.S. Pat. No. 8,485,147, a cylinder for an opposed-piston engine includes a liner 10 having a bore 12 and longitudinally displaced exhaust and intake ports 14, 16 that are machined or formed therein. One or more injector ports 17 open through the side surface of the liner. The two pistons 20 and 22 are disposed in the bore 12 with their end surfaces 20*e*, 22*e* in opposition to each other. In a compression stroke, the pistons move toward respective top center (TC) locations where they are at their innermost positions in the cylinder. When combustion occurs, the pistons move away from TC, toward respective ports. While moving from TC, the pistons keep their associated ports closed until they approach respective bottom center (BC) positions where they are at their outermost positions in the cylinder. An annular portion 25 of the liner surrounds the bore volume within which combustion occurs, that is to say, the portion of the bore volume in the vicinity of the piston ends when the pistons are at or near TC. For convenience, that portion of the liner is referred to as the "TC" portion. While the engine runs the TC portion 25 is subject to extreme strain from the temperatures and pressures of combustion. Consequently, there is a need for structural reinforcement and cooling measures at the TC portion 25 to mitigate the effects of combustion.

The '147 patent describes a cylinder structure in which the liner is provided with an annular reinforcing band encircling the TC portion of the liner sidewall and a metal sleeve received over the TC portion of the liner. The reinforcing band provides hoop strength to resist the pressure of combustion. Grooves disposed between the metal sleeve and the liner provide channels for a liquid coolant. Longitudinal coolant passageways drilled in the liner extend through bridges in the exhaust port to transport liquid coolant from the grooves. The grooves conduct liquid coolant from the vicinity of the reinforcing ring toward the ports; the drilled passageways provide an added measure of cooling to the exhaust port.

Manifestly, an opposed-piston cylinder liner presents unique engineering and manufacturing challenges. The thin exhaust port bridges are exposed to very hot exhaust gases during engine operation and consequently require coolant flow to maintain structural integrity. Furthermore the combustion volume of the cylinder, particularly in the annular TC portion of the liner, requires additional strength and coolant flow to withstand the extreme temperatures and high pressures of combustion.

One procedure for producing the coolant passageways through the exhaust port bridges includes gun drilling; see the above-referenced '147 patent, for example. According to another procedure, slots are machined or cast in the port bridges and then covered with a metal ring that is press-fit, welded soldered, or brazed to attach the ring to the liner. In this regard, see for example, U.S. Pat. No. 1,818,558 and U.S. Pat. No. 1,892,277. The high-pressure TC portion of the liner where combustion occurs may have grooves formed in the outer surface of the liner for coolant passages which are covered by a press-fit hard steel ring or sleeve to enclose the coolant and relieve hoop stress in the TC portion of the sleeve. In this regard, see U.S. Pat. No. 1,410,319, and the above-referenced '147 patent. All of these structures have limitations. Cold press-fit joints require precision manufacturing, extra components and precision assembly, all of which result in high cost. Welded joints change the microstructure of the joined pieces in local areas, thereby changing tempering and mechanical properties that can increase failure and scrap rates. Soldered or brazed joints include substrate material that can decay over time with varying results. Materials that are able to withstand the exhaust temperatures are expensive.

SUMMARY

Sintering a powdered metal (PM) ring over grooves machined, or otherwise produced, in the exhaust port bridges includes micro-melting of the ring to create a bond between the ring and the liner. Sintering a PM ring in the center band of the liner while utilizing thin metal tubes to cover cooling slots machined or otherwise formed in the liner wall can reduce manufacturing costs of the cylinder. The techniques described herein include heating the two parts to a firing temperature to micro melt the PM particles to the liner material. This produces an integral bond between the PM ring and the cylinder liner.

DETAILED DESCRIPTION OF THE PREFERRED EMBODIMENTS

Figure 1:
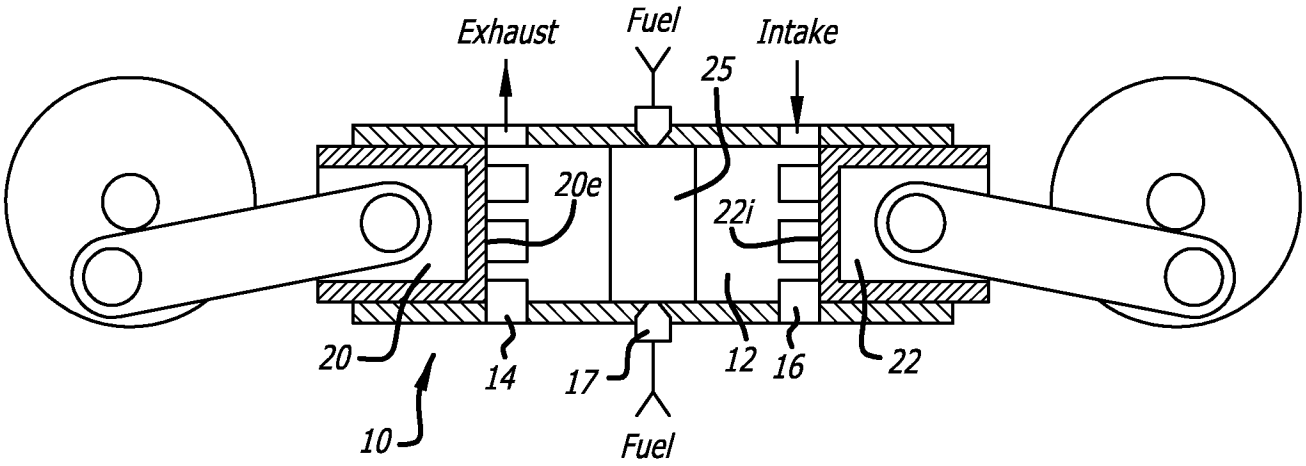
FIG. 1 (Prior Art)
FIG. 1 is a schematic drawing of an opposed-piston engine with opposed pistons near respective bottom center locations in a cylinder, and is appropriately labeled "Prior Art".

According to this disclosure, a cylinder liner for an opposed-piston engine has a bore, an annular TC portion, and longitudinally-separated exhaust and intake ports that transport exhaust gas from, and charge air into, the cylinder. Each of the ports is constituted of one or more sequences of openings through the liner sidewall that are separated by solid sections of the sidewall. These solid sections are called "bridges". In some descriptions, each exhaust and intake opening is referred to as a "port"; however, the construction and function of a circumferential array of such "ports" are no different than the port constructions shown in FIG. 1 and discussed herein.

Figure 2:
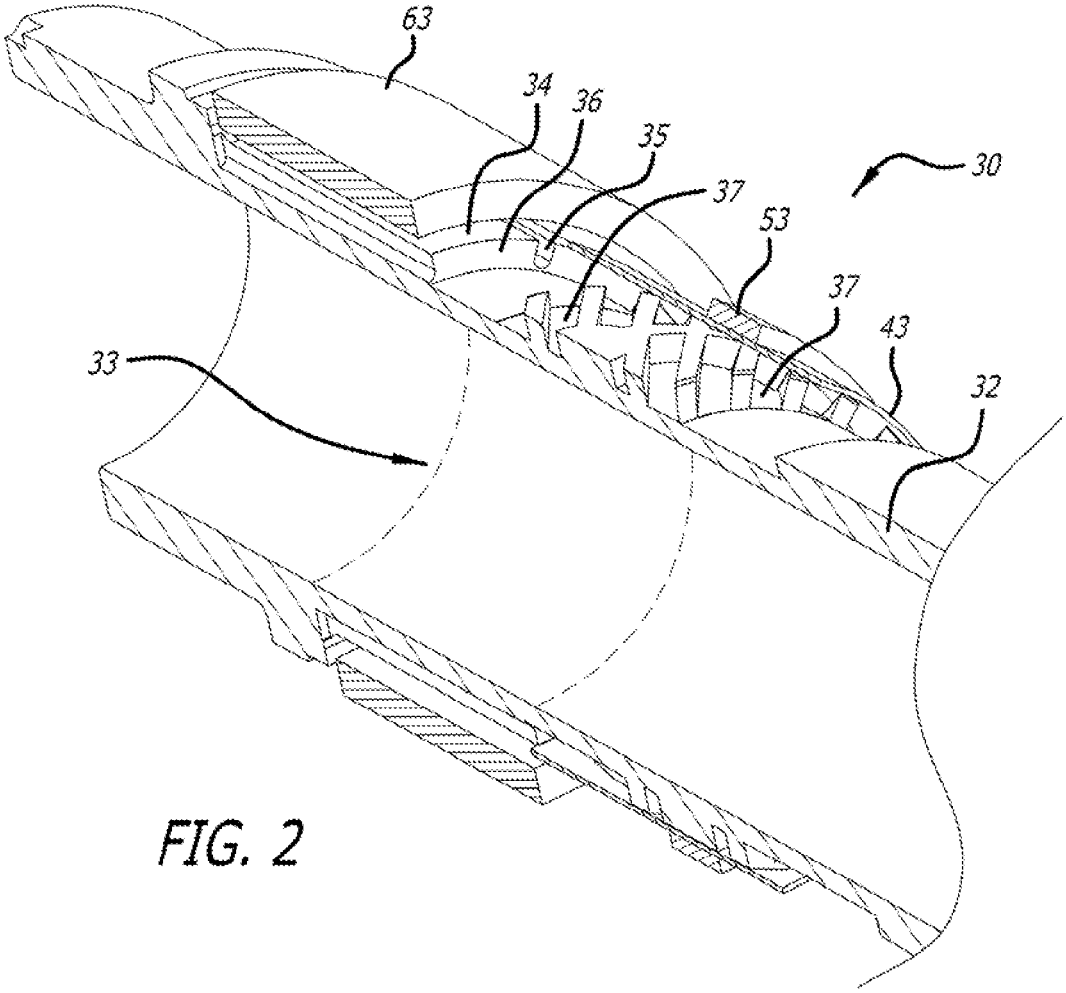
FIG. 2 is an isometric, cross-sectional view illustrating a cylinder liner structure according to a first embodiment of this disclosure.

FIG. 2 is a partial cross sectional view showing a first structure embodiment of a cylinder liner component 30 for an opposed-piston engine. The liner structure comprises a liner 32 with TC and exhaust portions 33 and 34, a coolant cover tube 43, a stiffener ring 53, and an exhaust port ring 63. The structure is assembled by forming the liner, press-fitting the coolant cover tube onto the liner, and then bonding the stiffener and exhaust cover rings to the liner and the coolant cover tube by a sintering process. In this regard, then, the material compositions of the liner, the cover tube, and the rings are selected for compatibility with the sintering process. Within this constraint, the specific material compositions for the liner, the coolant cover tube, and the rings are selected based upon anticipated running conditions of the opposed-piston engine such as engine load range, altitude, etc. For example, the liner 32 may be made of iron and the tube 43 may be made of rolled steel (or, possibly, aluminum). The rings 53 and 63 are powdered metal (PM) parts.

The liner 32 is manufactured with grooves 35, machined or otherwise produced, through pre-indexed exhaust port bridge locations 36 in the exhaust portion 34, and with slots 37 machined, or otherwise produced, through pre-indexed areas in the TC portion 33. Preferably, exhaust port openings and holes for injector ports are also machined or otherwise produced in the liner 32. A rolled, thin-walled steel cooling channel cover tube 43 is manufactured with enough width to enclose the cooling slots 37.

The rings 53 and 63 are manufactured by compaction, or by metal injection molding, of spheroidal particles (20 microns and smaller) of metal powder. A PM compaction process involves pouring the metal powder into a mold and then compressing the material at high pressures sufficient to allow the powder to cohere enough to initiate and maintain the sintering process and reach proper densification. Metal injection molding (MIM) involves mixing the metal powder with a thermo polymer, such as a polyethylene, and then injecting mixture into a mold as in a typical plastic injection molding process. The mixture is cured in the mold and then the polymer is then removed with an organic compound in a debinding process before it is sintered.

Preferably, the PM material comprises a steel-based alloy material such as a nickel-steel material having a composition in the range from FN-02xx (2% NiFe) to FN-04xx (4% NiFe) both of which have several heat-treat and post sintering temper options. An alternative family of PM material may be FLC-05xx, which has certain desirable properties and gains its post heat-treat from the sintering process thereby requiring no post sintering tempering.

Material selected for the cylinder liner must be compatible with the sintering and post heat-treat requirements (if any) of the PM material. As an example, FN-0208-HT100 PM material is compatible with post heat-treat requirements of a CL40 iron (steel) liner but would not work with a liner made of CL30 iron. If more strength is needed for the TC portion, the use of an FLC-0508 ring with a CL30 liner would be desirable as neither require post-heat treatment.

In some situations, such as high corrosive environments of maritime engines, where specific heat transfer requirements are relatively low, an FN-04xx (4% NiFe) or 50% Ni50% Fe materials might be desirable rather than FN-02xx (2% NiFe)n or FC-05xx that have better heat transfer qualities Cleaning of surfaces as may be required for these processes involves a different approach than would be used in prior art procedures. Since material with free iron particles will start to oxidize quickly, previous processes for mating two surfaces may result in a layer of oxidation between the two parts. Therefore, during the sintering process, a gas, (typically 90% N and 10% H), is introduced so that when the sintering temperature reaches 600° C., the oxygen, (and free carbons), will react with the hydrogen to remove oxidants and effectively "clean" all surfaces.

Exhaust Bridge Cooling Channel Cover Process

Figure 3A:
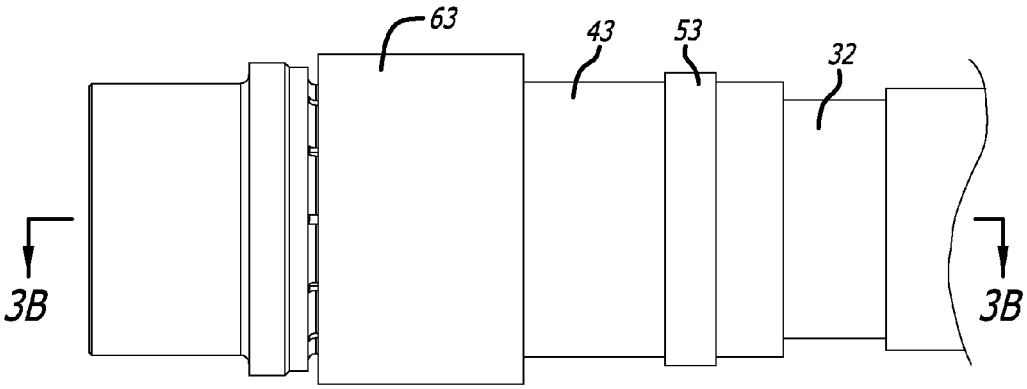
FIGS. 3A, 3B, and 3C illustrate a cylinder liner assembly sequence according to the first embodiment.
Figure 3B:
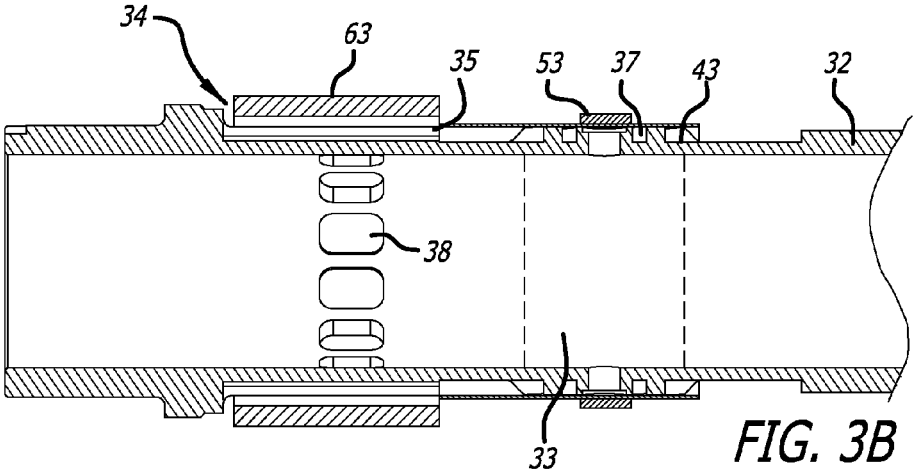
Figure 3C:
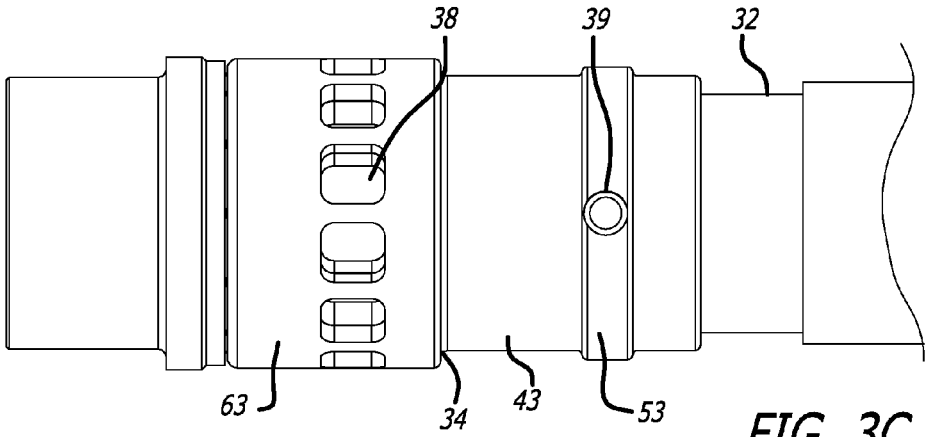

FIGS. 3A-3C illustrate a process for manufacturing a liner component of a cylinder for an opposed-piston engine to produce coolant passageways for exhaust port bridges. The process includes forming a liner and forming a PM exhaust ring as per the description above, and then positioning the exhaust port ring 63 over the exhaust port portion 34 of the liner 32 as shown in FIGS. 2 and 3A. The liner 32, with the exhaust ring 63 mounted thereto, is subjected to a firing temperature in a sintering oven to form an integral bond between the facing inner annular surface of ring 63 and outer surface of the liner exhaust portion 34 as shown in FIG. 3B. This covers the grooves 35, thereby forming coolant passageways between the ring and the exhaust port portion. As per FIG. 3C, the OD of the liner is machined as required and then the pre-indexed exhaust port openings 38 are formed by cutting through the exhaust ring 63.

Center Cooling Channel and Reinforcing Cover Process

FIGS. 3A-3C illustrate a process for manufacturing a liner component of a cylinder for an opposed-piston engine to produce coolant passageways and a stiffening ring for the TC portion 33. of the liner. The process includes forming a liner, forming a cooling channel cover tube, and forming a PM stiffening ring as per the description above and mounting the coolant channel tube 43 to the TC portion 33 of the liner 32. Next, the stiffening ring 53 is positioned over the tube 43, with the inner annular surface of the stiffening ring 53 facing the outer cylindrical surface of the tube 43, as shown in FIG. 3A. The liner 32, with the tube 43 and the ring 53 mounted thereto, is subjected to a firing temperature in a sintering oven to form an integral bond between the facing surfaces of the ring and the tube as shown in FIG. 3B. This covers the slots 37, thereby a forming coolant passageways between the ring and the TC portion. As per FIG. 3C, the OD of the liner is machined as required and then one or more pre-indexed injector port openings 39 are formed by drilling through the stiffening ring 53 and the tube 43.

Figure 4:
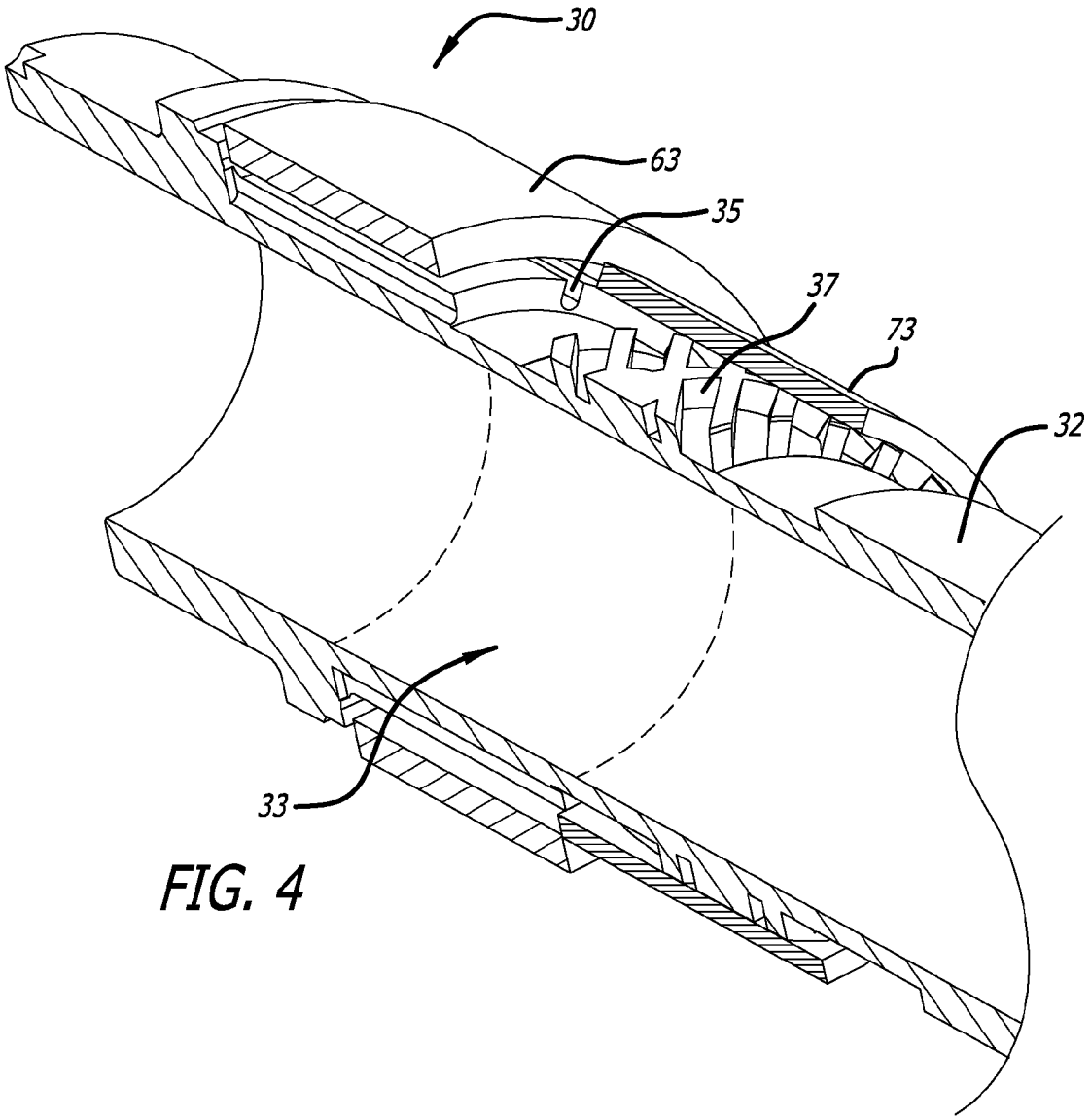
FIG. 4 is an isometric, cross-sectional view illustrating a cylinder liner structure according to a second embodiment of this disclosure.

FIG. 4 shows a cylinder liner structure according to a second embodiment of this disclosure. In this embodiment, the thin walled steel cooling chamber tube is eliminated and a PM center ring 73 is made large enough to cover the entire TC area 33, thereby covering the slots 37. When the assembled parts are heated to a firing temperature in a sintering oven, a leak-proof integral bond is formed between the PM center ring 73 and the outer surface of the liner 32, thus eliminating the need for the thin walled steel tube.

General Conditions/Requirements for Both Processes

Cleaning of any material to which the PM material will micro melt during sintering is important to provide for a firm melt bond. When preparing the liner, the cover tube and a PM material ring for sintering, the liner is stood on end and the ring is set on a ceramic substrate or support to axially position it precisely over the portion of the liner to which it will be sintered. The two processes described above can be performed simultaneously or in sequence. Although simultaneous sintering is preferred, it may be necessary to perform the processes separately because of post-sintering hardening requirements for some of the materials used. Some metals may require fast cooling for hardening whereas other metals may require slow cooling to ensure hardening. An alternative procedure for the center cooling and strength process would be to eliminate the coolant channel cover tube and make the PM stiffener ring wide enough to cover the entire TC area cooling channels. In this procedure, the PM stiffener ring would micro melt directly to the liner to form an integral bond between the two. This procedure may simplify manufacturing and ensure a full, leak-proof, seal of the coolant channels in the TC portion of the cylinder.

While embodiments of a cylinder liner structure for an opposed-piston engine have been illustrated and described herein, it will be manifest that such embodiments are provided by way of example only. Variations, changes, additions, and substitutions that embody, but do not change, the principles set forth in this specification, should be evident to those of skill in the art.

The invention claimed is:

1. A method of manufacturing a liner component for a cylinder of an opposed-piston engine, comprising:
- forming a cylinder liner of an iron material;
- forming a ring of a powdered metal (PM) material;
- positioning the ring over an exhaust port portion of the cylinder liner; and,
- forming coolant passageways between the ring and the exhaust port portion by bonding facing surfaces of the exhaust port portion and the ring.

2. The method of claim 1, further comprising forming exhaust port openings that extend through the ring and the exhaust port portion.

3. The method of claim 2, further comprising forming the ring from a steel-based alloy.

4. The method of claim 1 in which forming the cylinder liner includes forming grooves in exhaust port bridge locations in the exhaust port portion.

5. A method of manufacturing a liner component for a cylinder of an opposed-piston engine, comprising:
- forming a cylinder liner of an iron material;
- forming a tube of steel or aluminum material;
- forming a ring of a powdered metal (PM) material;
- forming coolant passageways between the tube and a top center portion of the liner by fitting the tube over the top center portion;
- positioning the ring over the tube, in alignment with the top center portion of the cylinder liner; and,
- stiffening the top center portion by bonding facing surfaces of the tube and the ring.

6. The method of claim 5, further comprising forming one or more injector port openings that extend through the ring, the tube, and the top center portion.

7. The method of claim 6, further comprising forming the ring from a steel-based alloy.

8. The method of claim 5, in which forming the cylinder liner includes forming slots in an annular section of the top center portion.

9. A method of manufacturing a liner component for a cylinder of an opposed-piston engine, comprising:
- forming a cylinder liner of an iron material;
- forming a ring of a powdered metal (PM) material;
- positioning the ring over a top center portion of the cylinder liner; and,
- stiffening the top center portion by bonding facing surfaces of the top center portion and the ring.

10. The method of claim 9, further comprising forming one or more injector port openings that extend through the ring and the top center portion.

11. The method of claim 10, further comprising forming the ring from a steel-based alloy.

12. The method of claim 9, in which forming the cylinder liner includes forming grooves in an annular section of the top center portion.

13. A method of manufacturing a liner component for a cylinder of an opposed-piston engine, comprising:
- forming a cylinder liner of an iron material;
- forming a ring of a powdered metal (PM) material;
- positioning the ring over a top center portion of the cylinder liner; and,
- forming coolant passageways between the ring and the top center portion by bonding facing surfaces of the top center portion and the ring.

14. The method of claim 13, further comprising forming one or more injector port openings that extend through the ring and the top center portion.

15. The method of claim 14, further comprising forming the ring from a steel-based alloy.

16. The method of claim 13, in which forming the cylinder liner includes forming slots in an annular section of the top center portion.

17. A liner component for a cylinder of an opposed-piston engine, comprising:
- a cylinder liner of an iron material;
- a ring of a powdered metal (PM) material positioned over a portion of the cylinder liner;
- a bond between facing surfaces of the ring and the portion of the cylinder liner; and,
- coolant passageways between the ring and the portion of the cylinder liner.

18. The liner component of claim 17, wherein the portion of the cylinder liner is one or both of an exhaust port portion and a top center portion.

19. The liner component of claim 17, wherein the portion of the cylinder liner includes grooves in exhaust port bridge sections, the liner component further including exhaust port openings between the exhaust port bridge sections, that open through the ring and the cylinder liner portion.

20. The liner component of claim 17, wherein the portion of the cylinder liner is a top center portion that includes slots, the liner component further including one or more injector port openings that open through the ring and the top center portion.

* * * * *

UNITED STATES PATENT AND TRADEMARK OFFICE

CERTIFICATE OF CORRECTION

PATENT NO. : 9,121,365 B1
APPLICATION NO. : 14/255756
DATED : September 1, 2015
INVENTOR(S) : Bryant A. Wagner It is certified that error appears in the above-identified patent and that said Letters Patent is hereby corrected as shown below:

In the Claims

Column 6, claim 19, line 42, change "grooves" to read -- slots --

Signed and Sealed this
Twenty-eighth Day of June, 2016

Michelle K. Lee

Michelle K. Lee
*Director of the United States Patent and Trademark Office*